US010843491B2

(12) United States Patent
Helma et al.

(10) Patent No.: US 10,843,491 B2
(45) Date of Patent: Nov. 24, 2020

(54) MEDIA UNIT LEVELING ASSEMBLY FOR MEDIA PROCESSING DEVICES

(71) Applicant: Zebra Technologies Corporation, Lincolnshire, IL (US)

(72) Inventors: Thomas R. Helma, Wakefield, RI (US); Morgan Hassan Malone, Swansea, MA (US)

(73) Assignee: Zebra Technologies Corporation, Lincolnshire, IL (US)

( * ) Notice: Subject to any disclaimer, the term of this patent is extended or adjusted under 35 U.S.C. 154(b) by 56 days.

(21) Appl. No.: 15/951,817

(22) Filed: Apr. 12, 2018

(65) Prior Publication Data

US 2019/0009580 A1 Jan. 10, 2019

Related U.S. Application Data

(60) Provisional application No. 62/529,572, filed on Jul. 7, 2017.

(51) Int. Cl.
*B41J 11/20* (2006.01)
*B41J 11/44* (2006.01)
(Continued)

(52) U.S. Cl.
CPC ..... *B41J 11/20* (2013.01); *B41J 11/04* (2013.01); *B41J 11/44* (2013.01); *B41J 13/025* (2013.01);
(Continued)

(58) Field of Classification Search
CPC ..... B41J 11/20
(Continued)

(56) References Cited

U.S. PATENT DOCUMENTS 1,515,986 A 11/1924 Wright et al.
3,636,316 A 1/1972 Suzuki et al.
(Continued)

FOREIGN PATENT DOCUMENTS

EP 385417 A2 9/1990
EP 623894 A1 11/1994
(Continued)

OTHER PUBLICATIONS

Zebra P630i/P640i Card Printer User's Manual, Manual, 2006, pp. 8, 26-28, 980541-003 Rev. A, ZIH Corp.
(Continued)

*Primary Examiner* — Anthony H Nguyen

(57) ABSTRACT

A media processing device includes: a platen roller configured to move a media unit along a media processing path to traverse a printhead adjacent to the platen roller; an upstream drive assembly including (i) an upstream stationary roller disposed along the media processing path on a first side of the platen roller; and (ii) an upstream movable roller adjacent to the upstream stationary roller; a downstream drive assembly including (i) a downstream stationary roller disposed along the media processing path on a second side of the platen roller; and (ii) a downstream movable roller adjacent to the downstream stationary roller; a controller configured to control a motor to move, according to a predefined sequence, the upstream movable roller and the movable roller between respective engaged and disengaged positions.

20 Claims, 13 Drawing Sheets

(51) Int. Cl.
*B41J 11/04* (2006.01)
*B41J 13/02* (2006.01)
*B41J 13/12* (2006.01)

(52) U.S. Cl.
CPC ..... *B41J 13/12* (2013.01); *B65H 2701/1914* (2013.01)

(58) Field of Classification Search
USPC ..... 400/659
See application file for complete search history.

(56) References Cited

U.S. PATENT DOCUMENTS 4,281,244 A 7/1981 Murata et al.
4,712,113 A * 12/1987 Brooks ..... B41J 33/36 242/349
4,971,310 A 11/1990 Motegi et al.
5,061,022 A 10/1991 Meriwether
5,329,302 A * 7/1994 Fogle ..... B41J 11/04 346/136
5,339,280 A * 8/1994 Goldberg ..... G07B 17/00508 346/134
5,521,627 A * 5/1996 Keung ..... B41J 2/325 347/218
5,768,143 A 6/1998 Fujimoto
5,980,142 A * 11/1999 Inui ..... B41J 2/32 400/708
6,042,283 A 3/2000 Koyabu et al.
6,084,624 A * 7/2000 Yamakawa ..... B41J 2/355 347/175
6,155,728 A * 12/2000 Sakaino ..... B41J 11/04 400/26
6,296,032 B1 * 10/2001 Louie ..... B26D 5/34 156/277
6,600,167 B2 7/2003 Sano
D527,044 S 8/2006 Harden et al.
7,328,897 B2 2/2008 Bryant et al.
7,416,179 B2 8/2008 Jones et al.
7,433,614 B2 10/2008 Suzuki
8,387,975 B2 3/2013 Suzuki
2002/0178939 A1 * 12/2002 Tsuruta ..... B41J 2/325 101/33
2003/0058326 A1 * 3/2003 Araki ..... B41F 19/062 347/217
2003/0090052 A1 5/2003 Hsiao et al.
2004/0109715 A1 6/2004 Meier et al.
2005/0078973 A1 4/2005 Suzuki
2005/0242488 A1 11/2005 Pelletier et al.
2006/0091331 A1 5/2006 Tanamachi
2006/0180971 A1 8/2006 Maruyama
2007/0009308 A1 1/2007 Shoji et al.
2007/0160406 A1 7/2007 Coles et al.
2007/0228647 A1 10/2007 Hara
2007/0235141 A1 * 10/2007 Chin ..... B32B 37/0046 156/552
2008/0100687 A1 5/2008 Abe et al.
2009/0189342 A1 7/2009 Abe et al.
2010/0289845 A1 11/2010 Conway et al.
2011/0049788 A1 3/2011 Suzuki et al.
2011/0056415 A1 3/2011 Moog et al.
2011/0091261 A1 4/2011 Honma et al.
2011/0123307 A1 5/2011 Pillard
2011/0217109 A1 9/2011 Cronin et al.
2012/0181741 A1 7/2012 Suzuki
2012/0181744 A1 7/2012 Suzuki
2013/0140759 A1 6/2013 Kuo
2013/0334771 A1 12/2013 Igarashi
2014/0374986 A1 12/2014 Takada
2015/0028532 A1 1/2015 Takahashi
2016/0229207 A1 8/2016 Perry et al.
2017/0021644 A1 * 1/2017 Goto ..... B41J 11/04

FOREIGN PATENT DOCUMENTS

EP 1510484 A1 3/2005
JP 200584439 A 3/2005
WO 2009/136129 A1 11/2009

OTHER PUBLICATIONS

Zebra P330i/330M Card Printer User's Manual, Manual, 2004/2005, pp. 26 and 27, 980459-001 Rev. C, ZIH Corp.
Printing and Encoding Solutions, Fargo HDP8500 Industrial Card Printer/Encoder, Brochure, 2014, p. 3, Fargo.
Polaroid XPS Card Printer, Installation and User Guide, Jun. 2011, entire document, Part No. 539957-020 Rev. A.
Evolis Tattoo 2: User's Guide, Sep. 2007, entire document, Evolis Card Printer.
International Search Report and Written Opinion for International Patent Application No. PCT/US2016/017996 dated Jun. 1, 2016.
Evolis Primacy User Guide, Manual, Sep. 2016, entire document, Ref# KU-PRM1-C37-ENC Rev. C6, Evolis.
NBS Technologies Card Printer, Javelin DNA User Guide Manual, Manual, 2015, entire document.
U.S. Appl. No. 14/670,961, filed Mar. 27, 2015.
U.S. Appl. No. 15/807,043, filed Nov. 8, 2017.
U.S. Appl. No. 15/644,017, filed Jul. 7, 2017.
U.S. Appl. No. 15/643,966, filed Jul. 7, 2017.
U.S. Appl. No. 15/643,925, filed Jul. 7, 2017.
U.S. Appl. No. 29/606,497, filed Jun. 5, 2017.
U.S. Appl. No. 29/609,961, filed Jul. 7, 2017.
U.S. Appl. No. 15/644,048, filed Jul. 7, 2017.
International Search Report and Written Opinion for International Application No. PCT/US18/39288; dated Oct. 24, 2018.

* cited by examiner

MEDIA UNIT LEVELING ASSEMBLY FOR MEDIA PROCESSING DEVICES

CROSS REFERENCE TO RELATED APPLICATIONS

This application claims priority from U.S. Provisional Patent Application No. 62/529,572, filed Jul. 7, 2017, the contents of which is incorporated herein by reference.

BACKGROUND

Media processing devices configured to process discrete media units, such as card printers configured to print identity cards, include printheads configured to apply indicia (e.g. images and text) to the cards. Printhead performance may be negatively affected by variations in the angle between the cards and the printhead.

DETAILED DESCRIPTION

Figure 1:
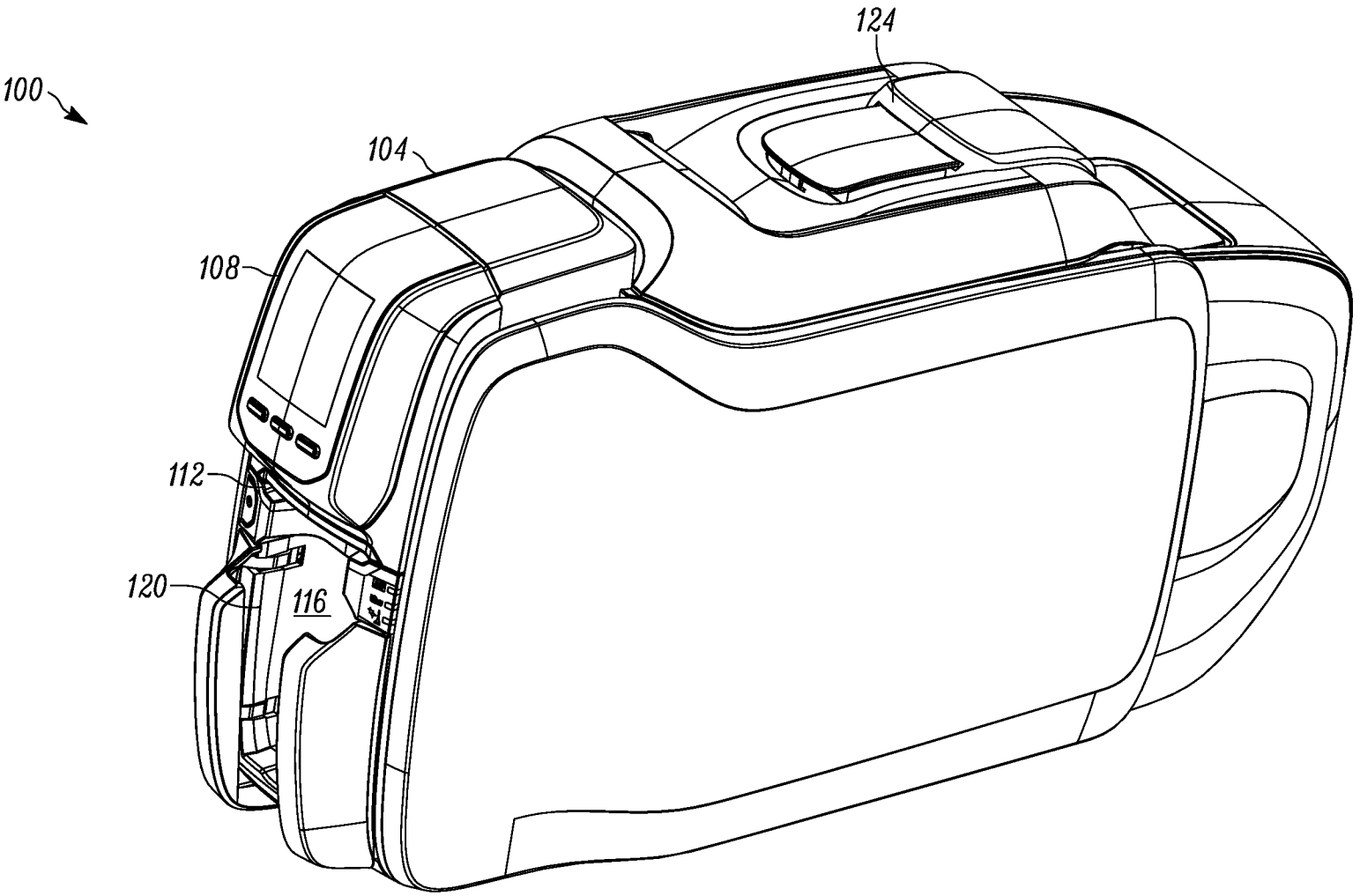
FIG. 1 depicts an example media processing device.

Some media processing devices are configured to process discrete media units, such as identity cards (e.g., driver's licenses or employee badges). Some examples disclosed herein are described using the term "cards." However, cards are example discrete media units and example methods and apparatus disclosed herein are applicable to any suitable type of discrete media unit(s).

Media processing devices typically drive a media unit such as a card past a printhead, which is configured to apply indicia to the surface of the card. The effectiveness of the printhead in applying such indicia may depend on the angle of the card relative to the printhead. Some printheads are movable, enabling the printhead to be controlled to adjust the above-mentioned angle during printing. In certain media processing devices, however, the angle of the card itself relative to the media processing device may vary during the card's travel past the printhead. When movement of the card is permitted as mentioned above, printing efficacy may be reduced, and printing artifacts such as acceleration induced density variations (also referred to herein as banding) appearing on the card may be introduced. Further, the potential for such movement may require the deployment of printheads with greater ranges of operational angles, which may reduce the efficacy of the printheads, increase the cost and complexity of the printheads, or both.

Some media processing devices implement nip rollers upstream and/or downstream of the printhead in an effort to constrain movement of the card away from the desired path of travel past the printhead. In such devices, however, the nip rollers are typically disengaged from the card when the printhead engages with the card, thus permitting undesirable card movement. Further attempts to resolve the above issues may include implementing nip rollers that are not disengaged. However, in devices in which the nip rollers that are not disengaged from the card, the trailing edge of the card may snap or jump upon leaving the nip roller as the card travels past the printhead. Such motion may lead to banding artifacts on the card.

Examples disclosed herein are directed to a media processing device including: a platen roller configured to move a media unit along a media processing path to traverse a processing head adjacent to the platen roller; an upstream drive assembly including (i) an upstream drive roller disposed along the media processing path on a first side of the platen roller; and (ii) a movable upstream nip roller housing carrying an upstream nip roller adjacent to the upstream drive roller; a downstream drive assembly including (i) a downstream drive roller disposed along the media processing path on a second side of the platen roller; and (ii) a movable downstream nip roller housing carrying a downstream nip roller adjacent to the downstream drive roller; a controller configured to control a motor to move, according to a predefined sequence, the upstream roller housing to engage the upstream nip roller with the upstream drive roller, and the downstream roller housing to engage the downstream nip roller with the downstream drive roller.

FIG. 1, below, depicts an example media processing device 100 constructed in accordance with the teachings of this disclosure. The media processing device 100 includes a housing 104 defined by a plurality of panels. The media processing device 100 stores a supply of discrete media units, such as cards (e.g. identity cards) in an unprocessed media source. In this example, the unprocessed media source is an input hopper (not shown) within the housing 104 and accessible from the exterior of the media processing device 100 via an input hopper door 108. The media processing device 100 also includes an auxiliary input slot 112 for insertion of single media units into the input hopper. The media processing device 100 generates indicia on a media unit from the input hopper before dispensing the media unit into a processed media output. In this example, the processed media output is an output hopper 116 accessible via an output opening 120. The indicia applied to the media units by the media processing device 100 are sourced from a cassette (e.g. a ribbon cassette) supported within the housing 104 and accessible from the exterior of the media processing device 100 via a cassette access door 124. In some examples, the access door 124 includes a lock to prevent unauthorized access to the interior of the media processing device 100 and, as described below, rejected media units. Notably, the output opening 120 associated with processed media (i.e., non-rejected cards) is separate from the reject area.

Figure 2:
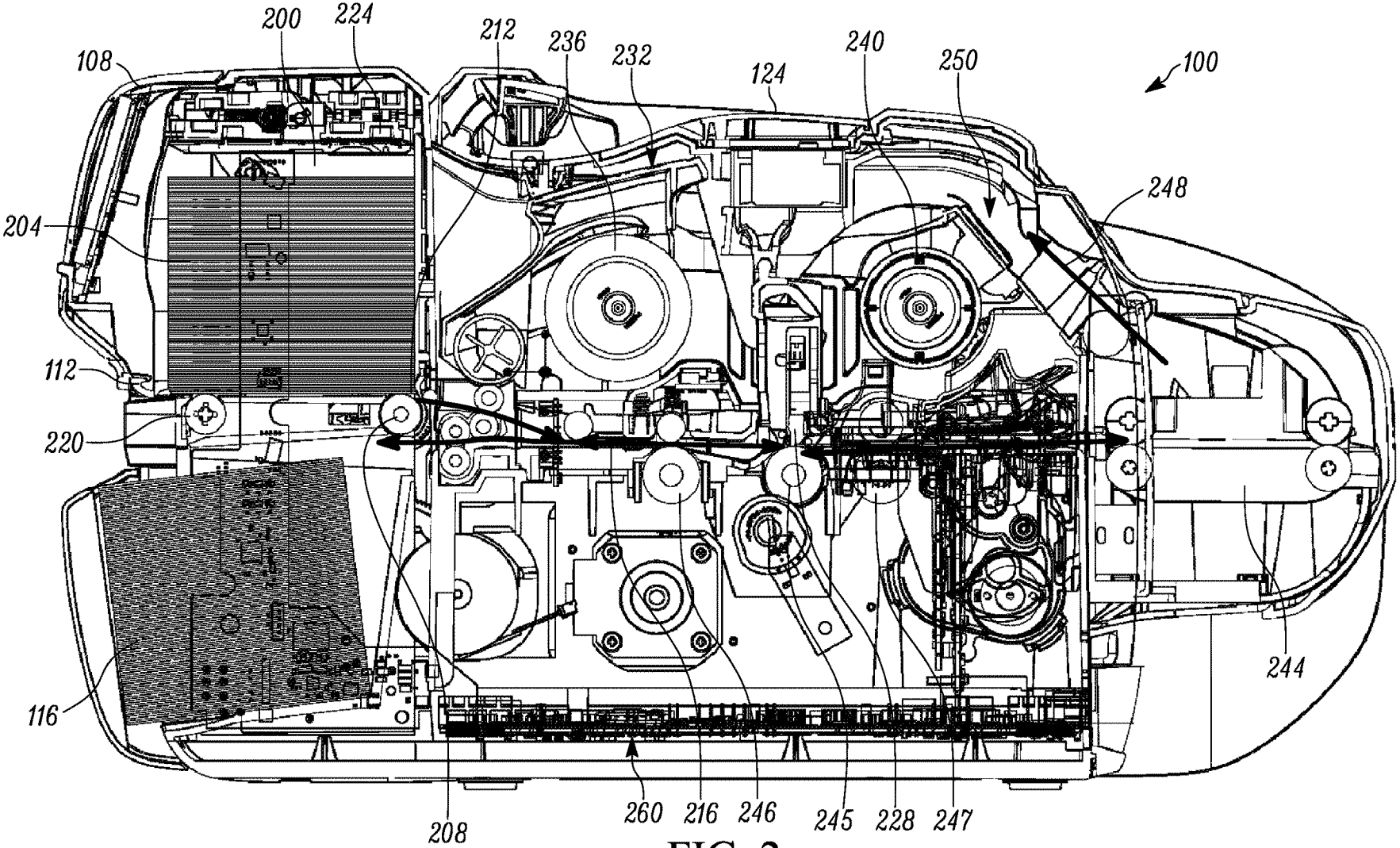
FIG. 2 depicts a cross-sectional view of the media processing device of FIG. 1.

Turning to FIG. 2, a cross-sectional view of the example media processing device 100 of FIG. 1 is depicted. As seen in FIG. 2, the media processing device 100 includes, within the housing 104, an unprocessed media input in the form of an input hopper 200. The input hopper 200 is configured to store a plurality of discrete media units 204, such as identity cards, in a substantially horizontal stack. The input hopper 200 may contain media units 204 of a variety of thicknesses. For example, each media unit 204 has a thickness of between about 0.2 mm and about 1 mm. Typically, the entire supply of media units 204 in the input hopper 200 at a given time have the same thickness. However, in some examples the media processing device 100 is also configured to process a set of media units 204 having a plurality of different thicknesses.

A pick roller 208 is disposed at an outlet 212 of the input hopper 200, and is configured to dispense a single media unit 204 from the input hopper 200 to a media transport assembly configured to guide the media unit 204 along a media processing path 216. The media processing device 100 also includes an input roller 220 at the slot 112, configured to drive a single media unit fed into the slot 112 underneath the stack of media units 204 already present (if any) in the input hopper. The single media unit fed into the slot 112 is then dispensed from the input hopper 200 for travel along the media processing path 216. In other words, the media processing device 100 is configured to process media units retrieved from the stack in the input hopper 200, as well as single-feed media units received via the input slot 112.

The input hopper 200 also contains a biasing assembly 224 disposed above the stack of media units 204. The pick roller 208 dispenses the bottom media unit from the stack of media units 204 by frictionally engaging with the bottom media unit 204. If insufficient force is exerted by the bottom media unit on the pick roller 208, the frictional engagement between the pick roller 208 and the media unit may be too weak for the pick roller 208 to grip and dispense the media unit 204. When the input hopper 200 is full, the weight of the stack of media units 204 alone may apply sufficient force for engagement between the bottom media unit and the pick roller 208. The biasing assembly 224 is configured to apply a progressively greater force to the top of the stack of media units 204 as the stack shrinks in size, thus maintaining a substantially constant force on the bottom media unit. The biasing assembly 224, in the present example, is implemented as a Sarrus linkage biased towards an extended position in which the biasing assembly 224 applies a force on the media units 204 (the linkage is shown in a retracted position in FIG. 2) by one or more biasing elements, such as a combination of coil springs.

The media transport assembly includes a plurality of rollers and guide surfaces. The media processing path 216, as seen in FIG. 2, extends from the input hopper 200 to a processing head 228, such as a printhead configured to apply indicia to the media unit 204 by transferring ink to the media unit 204. In this example, the media processing device 100 is a thermal transfer printer, and the printhead 228 is supplied with ink from a ribbon within a cassette 232 removably supported within the housing 104. The housing 104 includes an opening (not shown in FIG. 2) permitting access to the cassette 232. The above-mentioned cassette access door 124 has a closed position (shown in FIG. 2) for obstructing the opening to prevent access to the cassette 232, and an open position for permitting placement and removal of the cassette 232 into and out of the media processing device 100.

During printing operations, an ink ribbon (not shown) travels from a supply roller 236 of the cassette 232 to the printhead 228, and then to a take-up roller 240 of the cassette 232. The ribbon is driven by a motor configured to move the ribbon at a constant/controlled speed and/or tension. Oscillations in the speed or tension can result in banding artifacts. Accurate control of the speed and/or tension on the ribbon take-up side (i.e. via the take-up roller 240) can mitigate banding and other printing artifacts. A ribbon take-up motor is geared directly to the take-up roller 240 to control take-up of the spool of ribbon. As will be apparent to those skilled in the art, variations in tension of the ribbon during printing can cause uneven travel of the ribbon through the printhead 228, resulting in banding and other artifacts. In some examples, the ribbon take-up roller 240 or the motor driving the ribbon take-up roller 240 include a rotational sensor, such as a quadrature encoder, configured to transmit a signal representing the measured rotational speed of the ribbon take-up roller 240. The controller 260 is configured to modulate a supplied current (or other suitable operating parameter) to the motor based on the sensor signal, to maintain a substantially constant ribbon take-up speed. For example, the controller 260 may store a target velocity, and modulate the current supplied to the motor driving the take-up roller 240 based on a deviation between the target velocity and the actual velocity as indicated by the sensor. Oscillatory behavior of the ribbon in a controlled tension environment may therefore be suppressed.

As the ink ribbon and the media unit 204 pass the printhead 228, the ink ribbon is in contact with the media unit 204. To generate the above-mentioned indicia, certain elements (e.g., printhead dots) of the printhead 228 are selectively energized (e.g., heated) according to machine-readable instructions (e.g., print line data or a bitmap). When energized, the elements of the printhead 228 apply energy (e.g., heat) to the ribbon to transfer ink to specific portions of the media unit 204.

In some examples, processing of the media unit 204 also includes encoding data in an integrated circuit, such as a radio frequency identification (RFID) tag, magnetic strip, or combination thereof, embedded in the media unit 204. Such processing may occur at the printhead 228 mentioned above, or at a distinct secondary processing head upstream or downstream of the printhead 228 along the media processing path 216.

Having traversed the printhead 228, the media unit 204 is transported along the media processing path 216 to the output hopper 116. In the present example, prior to arriving at the output hopper, however, the media unit is transported to a media unit redirector 244 controllable to reverse, or flip, the media unit 204 by receiving the media unit 204, rotating by about 180 degrees, and expelling the media unit 204. The redirector 244 is configured to perform the above functions (receiving, flipping, and expelling a media unit 204) under motive power supplied by a single source, such as a motor.

Accordingly, the media transport assembly is configured to operate in two opposite directions along at least a portion of the media processing path 216 (illustrated in double lines). Specifically, the media processing path 216 proceeds in a return direction (as opposed to an outbound direction from the input hopper 200 to the printhead 228 and the redirector 244, described above) from the redirector 244 to the printhead 228. As a result of the media unit 204 having been flipped at the redirector 244, on the return pass of the printhead 228 an opposite side of the media unit 204 is exposed to the printhead 228 than on the outbound pass of the printhead 228. The media processing device 100, in other words, is capable of applying indicia to both sides of the media unit 204, before the media unit 204 is transported along the remainder of the media processing path 216 to the output hopper 116.

Prior to entering the redirector 244, the media unit 204 is transported by rollers 246 and 247 of the above-mentioned transport assembly, to traverse one or more registration assemblies, as will be discussed below. At least one of the registration assemblies is configured to align the media unit 204 laterally (that is, in a direction substantially perpendicular to the direction of travel along the media processing path 216) before the media unit 204 enters the redirector 244. Further, as also discussed below, the registration assembly is configured to retract away from the media processing path 216 as the media unit 204 exits the redirector 244 in the return direction.

As noted above, on either side of a print platen roller 245 (adjacent to the printhead 228) are rollers 246 and 247. The rollers 246 and 247 are also referred to as stationary rollers in the discussion below. In particular, although the rollers 246 and 247 rotate about respective axes, the axes themselves are stationary. That is, the positions of the rollers 246 and 247 relative to the media processing path 216 is static, notwithstanding the rotation of the rollers 246 and 247. Further, in the present example the stationary rollers 246 and 247 are driven by one or more motors (not shown in FIG. 2) to propel the media unit 204 along the media processing path 216. Accordingly, the stationary rollers 246 and 247 may also be referred to as drive rollers or stationary drive rollers. In other examples, one or both of the stationary rollers 246 and 247 can be passive rollers (i.e. not driven).

As will be discussed below in greater detail, each of the stationary rollers 246 and 247 are components of respective upstream and downstream drive assemblies. The above-mentioned assemblies also include respective movable rollers adjacent to the corresponding stationary roller. The movable rollers (not shown in FIG. 2) are movable relative to the stationary rollers 246 and 247 in that the axes of rotation of the movable rollers are movable relative to the media processing path 216 (and therefore also relative to the stationary rollers 246 and 247) between engaged and disengaged positions. As will be discussed below, in the engaged position, a given one of the movable rollers is positioned at a first distance from the corresponding stationary roller to engage with the media unit 204 as the media unit 204 traverses the printhead 228. That is, when the movable roller is in the engaged position, the movable roller and the corresponding stationary roller form a nip through which the media unit 204 may pass, dimensioned to provide traction between the media unit and the rollers. The movable rollers therefore may also be referred to herein as movable nip rollers, or simply as nip rollers. In the disengaged position, in contrast, the movable rollers are positioned at second distances, larger than the first distances mentioned above, from the corresponding stationary rollers. The nip formed in the engaged position is therefore disengaged, and the media unit 204 may contact one, or neither, of the rollers. The movable rollers are passive (i.e. not driven) in the examples discussed below. However, in other examples one or both of the movable rollers may be driven, in addition to or instead of the stationary rollers 246 and 247.

As will be discussed below, the media processing device 100 includes further components configured to control the positions of the above-mentioned movable rollers relative to the stationary rollers 246 and 247, and to control the position of the printhead 228 relative to the platen roller 245. The control of the movable roller and printhead positions, as will be apparent in the discussion below, may serve to reduce undesirable movement of the media unit 204, particularly relative to the printhead 228, as the media unit 204 travels along the media processing path 216.

Figure 3:
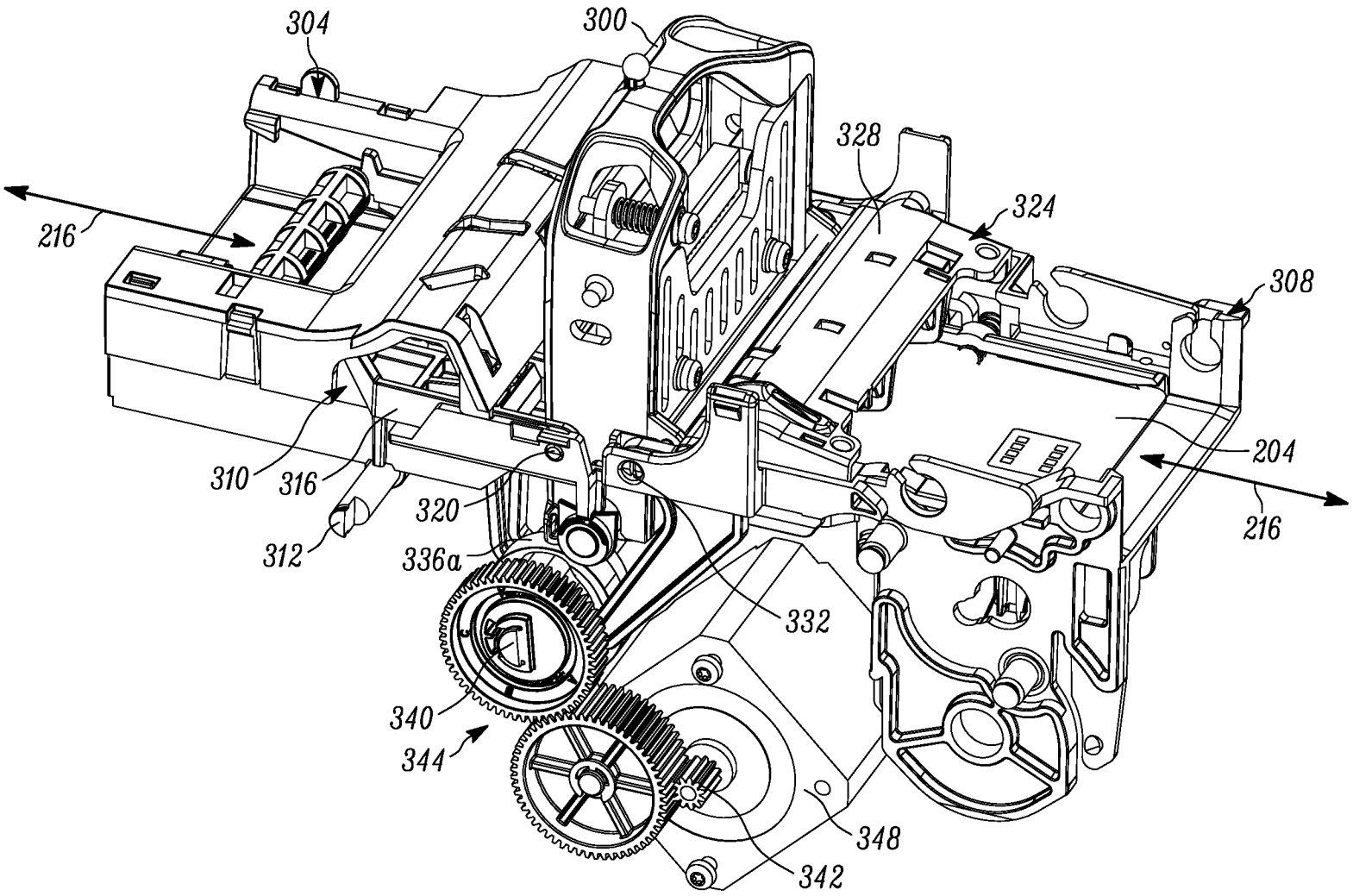
FIG. 3 depicts a top-right isometric view of certain internal components of the media processing device of FIG. 1.

Turning to FIG. 3, certain internal components of the example media processing device 100 shown in FIGS. 1 and 2 are illustrated. In particular, a printhead housing 300 that contains the printhead 228 (not visible in FIG. 3) is shown, along with an upstream support member 304 and a downstream support member 308 that define portions of the media processing path 216. The upstream support member 304 is referred to as "upstream" because it is arranged between the printhead 228 (and by extension the printhead housing 300) and the input roller 220 mentioned earlier. The downstream support member 308 is referred to as "downstream" because it is arranged such that the printhead 228 is between the downstream support member 308 and the input roller 220. In other words, the downstream support member 308 is further along the media processing path, relative to the input roller 220, than the printhead 228.

The upstream and downstream support members 304 and 308 can be integrally formed with the housing 104, or can be discrete components that are fixed to the housing 104. The support members 304 and 308 are typically static, and support other components of the media processing device 100, some of which are movable. Among the components supported by the upstream support member 304 is an upstream drive assembly 310, which includes the upstream stationary roller 246 mentioned above. The upstream stationary roller 246 is mounted for rotation on a shaft 312, which is supported by the upstream support member 304 in the illustrated example. In the present example, the shaft 312 is connected to a motor (not shown), and the upstream stationary roller 246 is therefore also referred to in the discussion below as the upstream drive roller 246. The upstream drive assembly 310 also includes an upstream nip roller housing (which may also be referred to as a nip roller carriage) 316 that rotatably supports the upstream movable roller (not shown in FIG. 3) mentioned above. The upstream nip roller housing 316 is movable between raised and lowered positions corresponding to the disengaged and engaged positions mentioned earlier, for disengaging and engaging the upstream movable roller with the media unit 204, respectively. The upstream nip roller housing 316 is movable between the above-mentioned positions, in the present example, by rotation relative to the upstream support member 304, for example about a pivot axis defined by mounting pins 320 that engage with corresponding openings in the support member 304.

The downstream support member 308 supports a downstream drive assembly 324, which includes the stationary roller 247 (not shown in FIG. 3). In the present example, the stationary roller 247 is driven by a motor (not shown), and the stationary roller 247 is therefore also referred to in the discussion below as the downstream drive roller 247. The downstream drive assembly 324 also includes a downstream nip roller housing 328 that is movable between raised and lowered positions corresponding to the disengaged and engaged positions mentioned earlier, to engage and disengage a downstream movable roller (not shown) with the media unit 204. The downstream nip roller housing 328 is movable via rotation relative to the downstream support member 308, for example about a pivot axis defined by mounting pins 332 that engage with corresponding openings in the support member 308.

Control of the position of each of the upstream and downstream nip roller housings 316 and 328 is achieved, in the illustrated example, by engagement between the nip roller housings 316 and 328 and a plurality of cam surfaces. The cam surfaces, as will be discussed in greater detail below, are implemented on a cam member 336*a*. The cam member 336*a* is mounted on a drive shaft 340 which is coupled to an output 342 (e.g. a pinion) of a motor 348 by a drivetrain segment 344 (a pair of gears, in the present example). The media processing device 100 includes a controller 260 coupled to the motor 348 and configured to control the motor 348 to drive the shaft 340 through a plurality of predefined arcs during operation of the media processing device 100. As will be discussed below, each predefined arc of the drive shaft 340 places the cam surfaces of the cam member 336*a* in a predefined position. The position of the media unit 204 along the media processing path 216 is controlled, via control of another motor (not shown) coupled to the drive rollers 246 and 247, as well as the platen roller 245. The position of the media unit 204 is controlled in conjunction with the position of the cam member 336*a*. Accordingly, each position of the cam member 336*a* corresponds to a segment of the media processing path 216 traveled by the media unit 204.

Figure 4:
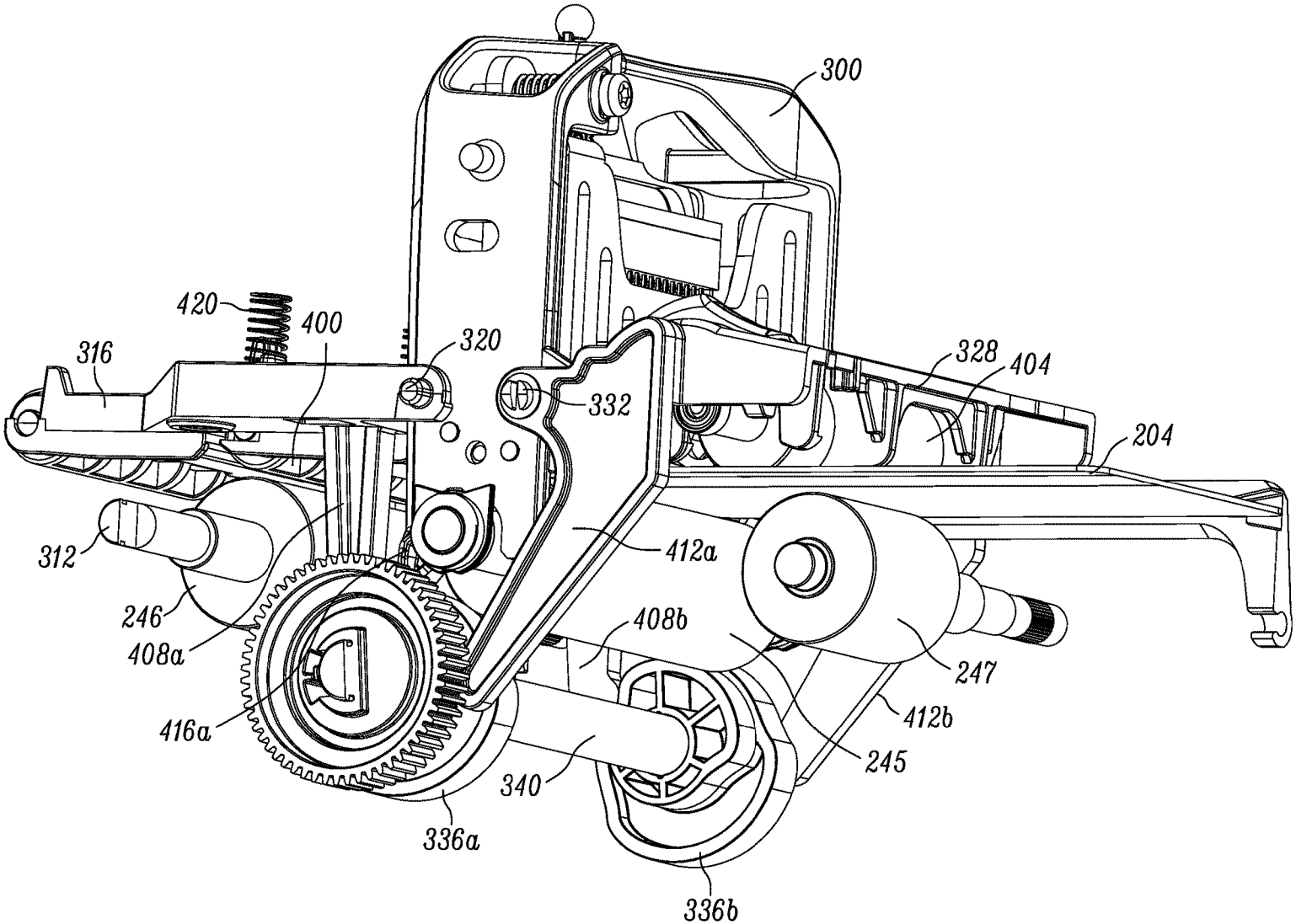
FIG. 4 depicts a bottom-right isometric view of upstream and downstream drive assembly components of the media processing device of FIG. 1.

Turning to FIG. 4, a subset of the components of the media processing device 100 depicted in FIG. 3 are shown. The motor 348 and a portion of the drivetrain segment 344 are omitted, as are the upstream and downstream support members 304 and 308. The upstream drive roller 246, the downstream drive roller 247, and the platen roller 245 are visible in FIG. 4. In addition, the upstream and downstream nip roller housings 316 and 328 are shown as supporting, respectively, an upstream movable roller 400 and a downstream movable roller 404. In the discussion below, the movable rollers 400 and 404 are also referred to, respectively, as the upstream nip roller 400 and the downstream nip roller 404.

The cam member 336*a* is also illustrated in FIG. 4, as well as an addition cam member 336*b* mounted on the drive shaft 340. Although two cam members 336 are shown in the illustrated example, in other examples one of the cam members 336 may be omitted. Additionally, the upstream nip roller housing 316 includes arms (which may also be referred to as cam followers) 408*a* and 408*b* for engaging with a first subset of the cam surfaces of the cam members 336*a* and 336*b*, respectively. The downstream nip roller housing 328 includes arms 412*a* and 412*b* for engaging with a second subset of the cam surfaces of the cam members 336*a* and 336*b*, respectively. Further, the printhead housing 300 includes arms 416*a* (shown in FIG. 4) and 416*b* (shown in FIG. 5) configured to engage with a third subset of the cam surfaces of the cam members 336.

One or both of the upstream and downstream nip roller housings 316 and 328 are biased toward the engaged positions (i.e. to bias the nip rollers 400 and 404 toward the media processing path 216 for engaging the media unit 204). For example, as shown in FIG. 4, one or more bias members 420, such as springs, are coupled to the upstream nip roller housing 316 for engaging with the upstream support member 304 and biasing the upstream nip roller housing 316 toward the media processing path 216.

Figure 5:
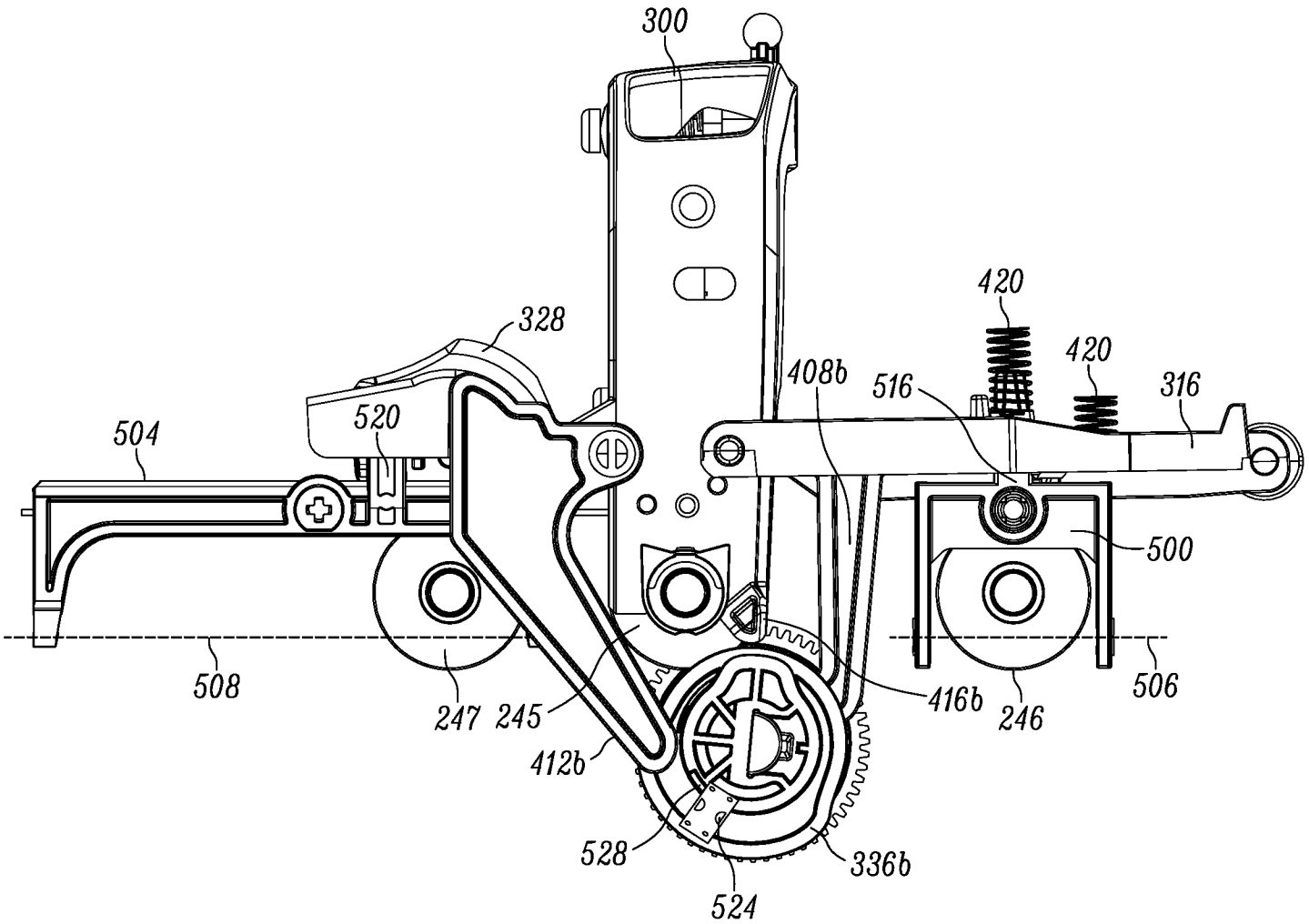
FIG. 5. depicts a side elevation view of the components of the media processing device shown in FIG. 4.

Turning to FIG. 5, as noted above the arm 416*b* of the printhead housing 300 is illustrated. In addition, FIG. 5 illustrates an upstream registration bar 500 and a downstream registration bar 504, each configured to align the media unit 204 as the media unit 204 travels past the printhead 228. As will be discussed in greater detail below, the registration bars 500 and 504 are configured, in the present example, to transition between engaged and disengaged positions by rotating about respective pivot axes 506 and 508 defined by engagement with the upstream and downstream support members 304 and 308. More specifically, the registration bars 500 and 504 each include a post 516 and 520, respectively, configured to engage with the upstream and downstream nip roller housings 316 and 328. The engagement between the posts 516 and 520 and the housings 316 and 328, respectively, causes the registration bars 500 and 504 to transition between the above-mentioned positions responsive to movement of the nip roller housings 316 and 328.

Also shown in FIG. 5, the media processing device 100 can also include a cam position sensor 524, such as a gap sensor, configured to detect a tab or flag 528 on the cam member 336*b*. The above-mentioned controller 260 is enabled, via the signal from the sensor 524, to determine the position of the cam members 336 and to therefore select the appropriate preconfigured control signals for transmission to the motor 348.

Figure 6:
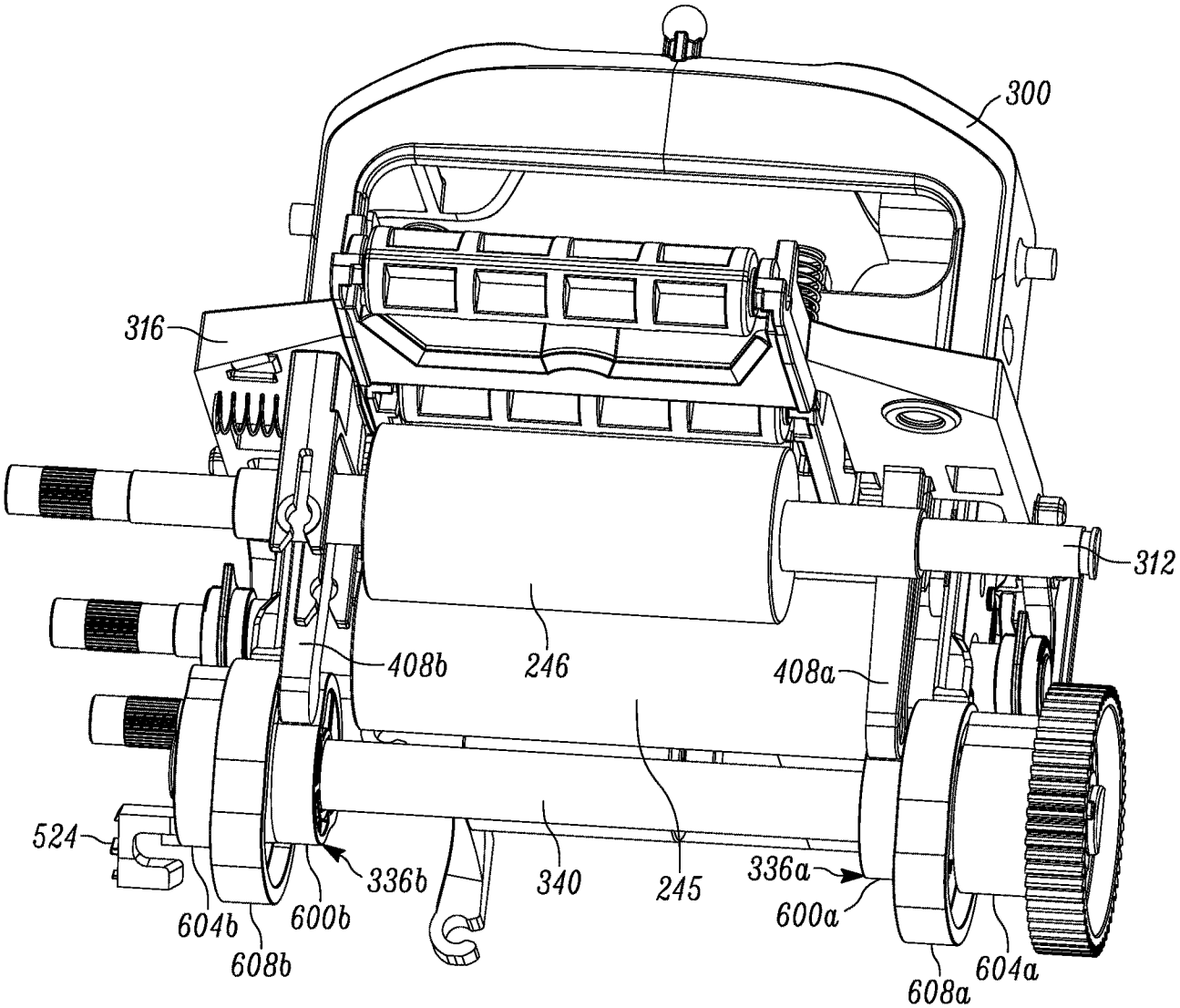
FIG. 6 depicts a bottom-front isometric view of upstream and downstream drive assembly components of the media processing device of FIG. 1.

Turning to FIG. 6, the cam members 336 are illustrated in greater detail. In particular, each cam member 336 includes a first subset of cam surfaces 600, a second subset of cam surfaces 604, and a third set of cam surfaces 608. As noted above, the first subset of cam surfaces 600 is configured to engage with the corresponding arm 408; the second subset of cam surfaces 604 is configured to engage with the corresponding arm 412; and the third subset of cam surfaces 608 is configured to engage with the corresponding arm 416. Each of the above-mentioned subsets of cam surfaces includes one raised surface, or lobe, and one lowered surface, or base. The shapes and relative positions of the lobes in each of the subsets 600, 604 and 608 are selected according to the sequence of movements of the upstream and downstream nip roller housings 316 and 328 and the printhead housing 300 to be effected during operation of the media processing device 100. The shapes and positions of the cam surfaces will now be described in conjunction with the operation of the media processing device 100, with reference to FIGS. 7-11. In each of FIGS. 7-11, the printhead housing 300 is omitted to illustrate the position of the printhead 228 itself.

Prior operation of the media processing device 100 to process the media unit 204, the above-mentioned controller 260 can be configured to perform an initialization process to place the cam members 336 in a predetermined initial position. For example, the controller 260 can be configured to determine whether the sensor 524 is obstructed (by the tab 528). When the sensor 524 is obstructed, the controller 260 is configured to cause the motor 348 to advance until the sensor 524 is no longer obstructed. The controller 260 can also cause the motor 348 to advance through a predetermined initialization arc (e.g. a predetermined number of steps) once the sensor 524 is unblocked.

Figure 7:
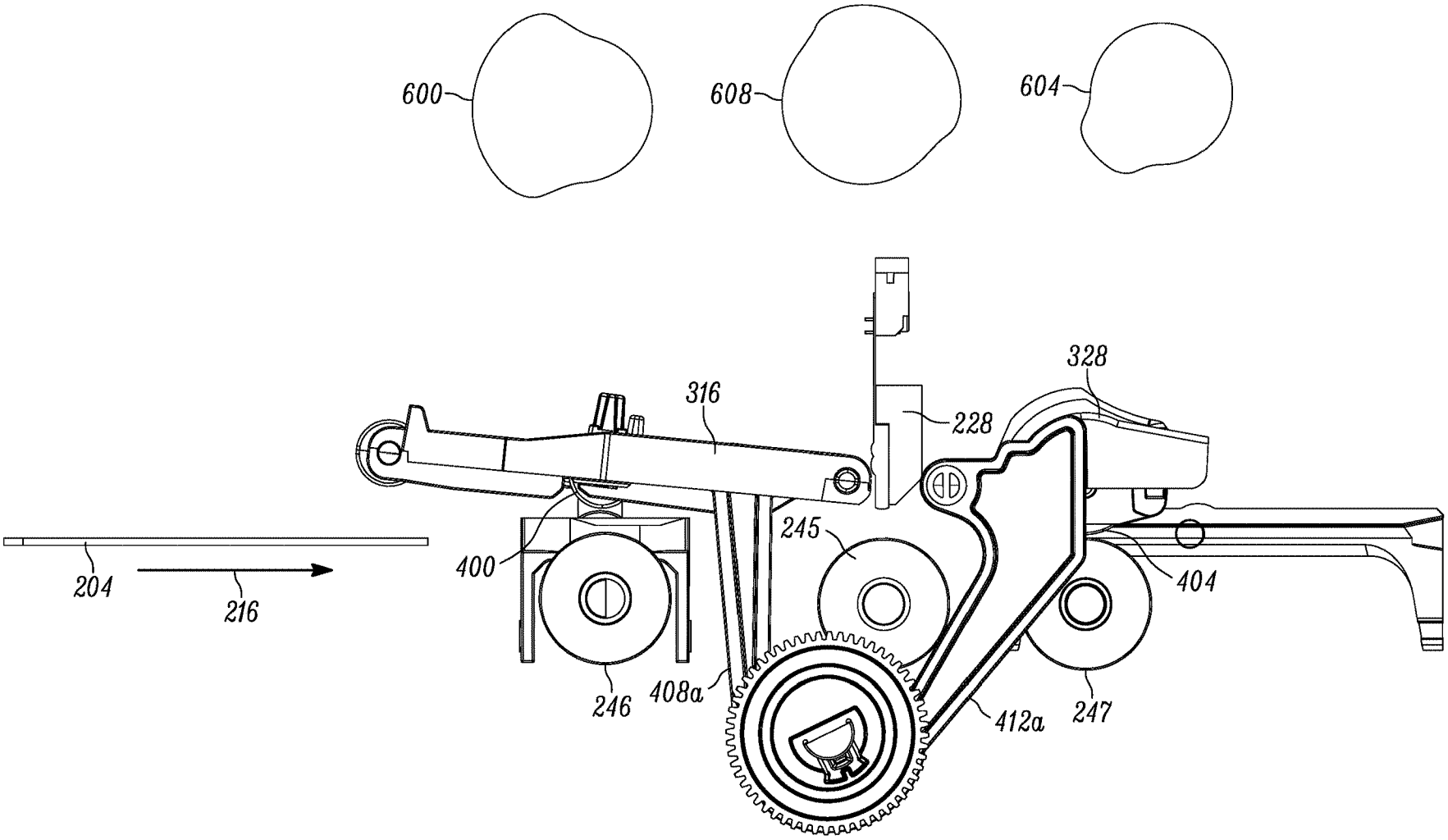
FIGS. 7-11 depict side elevation views of the upstream and downstream drive assembly components of the media processing device of FIG. 1 in a sequence of operational positions.

When the sensor 524 is not obstructed, the controller 260 is configured to drive the motor 348 until the sensor 524 is blocked. The controller 260 is then configured to perform the process above to place the cam members 336 in a known "home" or initial position. The initial position is shown in FIG. 7. In particular, the positions of the lobes of each subset of cam surfaces 600, 604 and 608 are shown. Due to the engagement between the arms 408 and the subset 600, the engagement between the arms 412 and the subset 604, and the engagement between the arms 416 (not shown due to the omission of the printhead housing 300) and the subset 608, initial positions are defined by the cam members 336 for each of the upstream nip roller housing 316, the downstream nip roller housing 328 and the printhead housing 300 (and therefore the printhead 228). In particular, the upstream nip roller housing 316 is in the raised position, such that the upstream nip roller 400 is lifted away from the media processing path 216. Further, the printhead 228 is also in a raised position, while the downstream nip roller housing 328 is in a lowered position, in which the downstream nip roller 404 is engaged with the downstream drive roller 247 at the media processing path 216.

The controller 260 is configured to detect the arrival of a media unit 204 via a signal from a media unit detection sensor (not shown) upstream of the drive roller 246. The media unit 204 is shown travelling toward the printhead 228 along with media processing path 216. Responsive to detection of the media unit 204, the controller 260 is configured to drive one or more rollers upstream of the upstream drive roller 246 to propel the media unit 204 toward the upstream drive roller 246. The controller 260 is also configured to drive the motor 348 through a predetermined arc (e.g. a predetermined number of steps) to rotate the cam members 336 to a second position.

Figure 8:
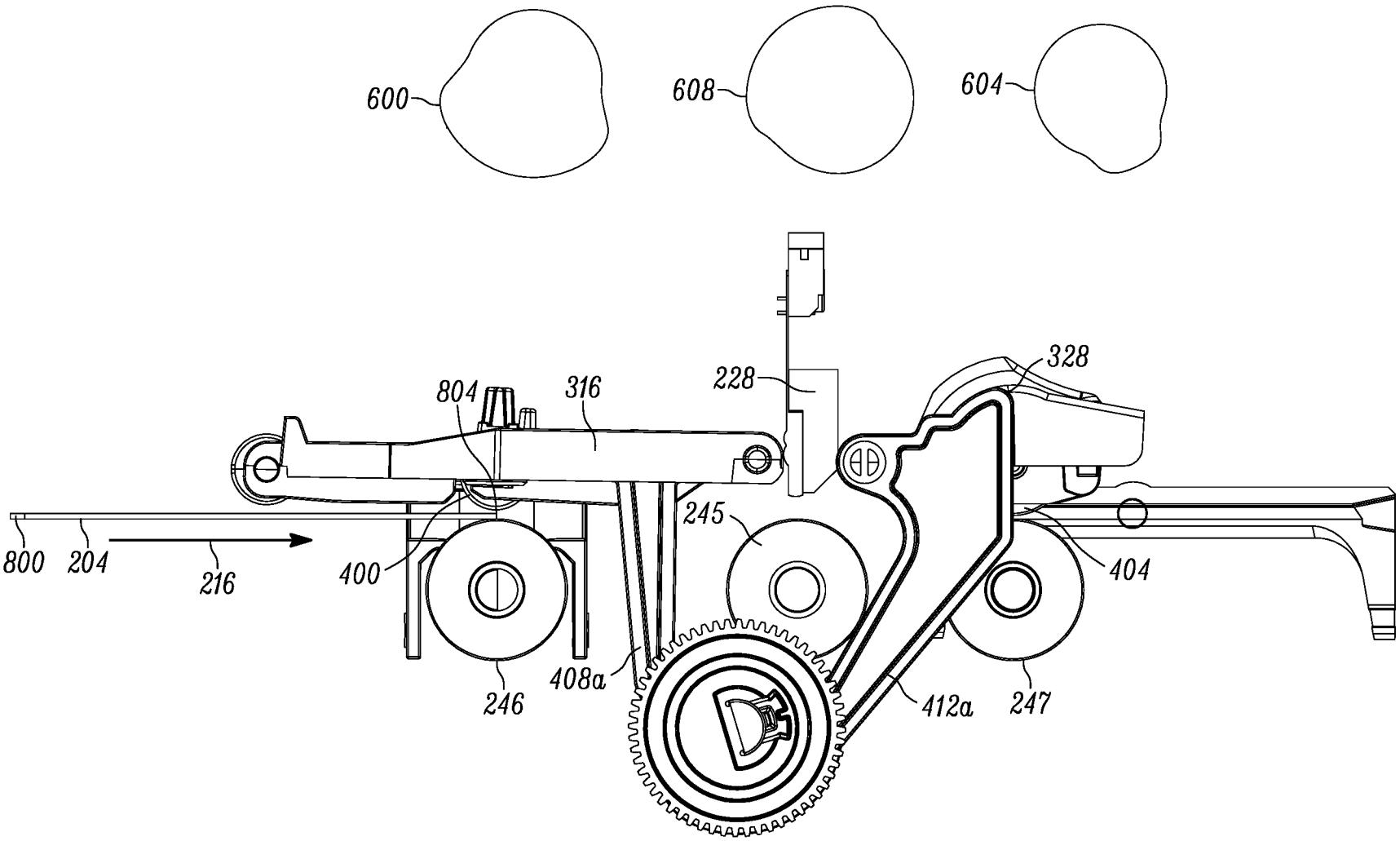

Turning to FIG. 8, the second position of the cam members is shown following the above-mentioned rotation by the motor 348. In particular, the lobes of the subsets 600, 604 and 608 have rotated counter-clockwise. While the printhead 228 and the downstream nip roller housing 328 remain in the positions shown in FIG. 7, the upstream nip roller housing 316 has transitioned to the lowered, or engaged position. The upstream nip roller 400 is therefore in position to engage the media unit 204 as the media unit 204 arrives at the upstream drive roller 246. As will be apparent from FIG. 8, the movement of the upstream nip roller housing 316 is caused by the rotation of the lobes in the first subset 600 out of engagement with the arms 408, such that the arms 408 engage instead with the base surfaces in the subset 600.

The controller 260 is configured to continue driving the media unit 204 (including via the drive roller 246) along the media processing path 216 with the nip rollers 400 and 404, and the printhead 228, in the positions shown in FIG. 8, until the media unit 204 approaches the printhead 228. In the present example, the above-mentioned media unit detection sensor is placed in the device 100 such that a trailing edge 800 of the media unit 204 unblocks the media unit detection sensor as a leading edge 804 of the media unit 204 approaches the printhead 228. When the media unit 204 approaches the printhead 228, the controller 260 is configured to drive the motor 348 through another predetermined arc (which can have the same length or a different length from the previously mentioned arcs), to advance the cam members 336 to the next position in the predefined sequence.

Figure 9:
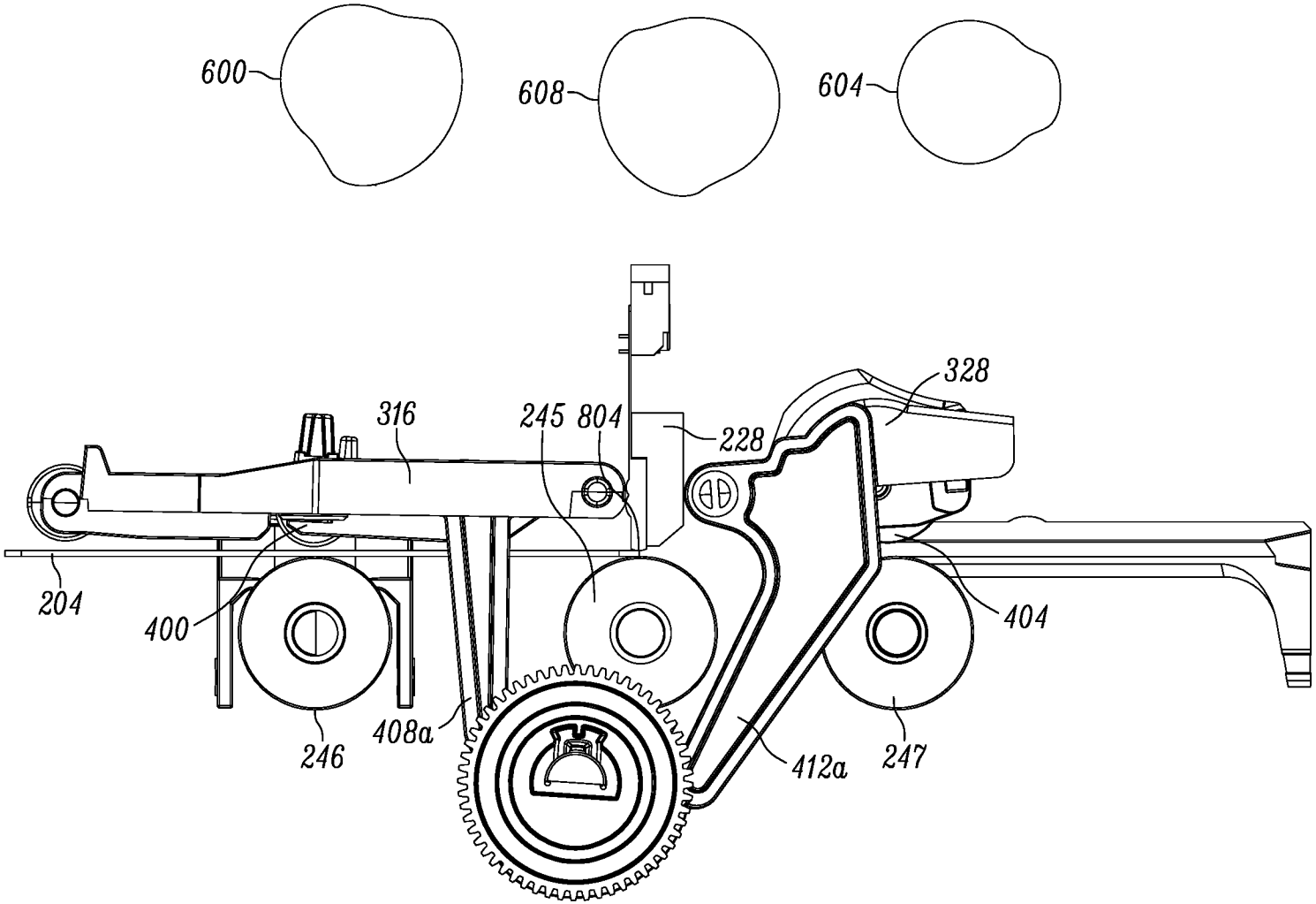

The position of the media unit 204 when the cam members 336 are advanced to the next position is shown in FIG. 9. In particular, as the leading edge 804 arrives under the printhead 228, the cam members 336 are rotated to place the subsets 600, 604 and 608 in the positions shown in FIG. 9. In particular, the printhead 228 is lowered into position for engaging the media unit 204, and the downstream nip roller housing 328 is raised into the disengaged position, such that the downstream nip roller 404 is lifted away from the media processing path 216. Responsive to placing the cam members 336 in the positions shown in FIG. 9, the controller 260 can be configured to begin operation of the printhead 228, along with the take-up roller 240 and other components of the device 100 involved in applying indicia to the media unit 204. The controller 260 is configured to continue driving the media unit 204 past the printhead 228, as the printhead 228 applies indicia to the media unit 204. When the leading edge 804 of the media unit 204 arrives under the downstream drive roller 247, the controller 260 is configured to drive the cam members 336 (via operation of the motor 348) to the next position in the sequence.

Figure 10:
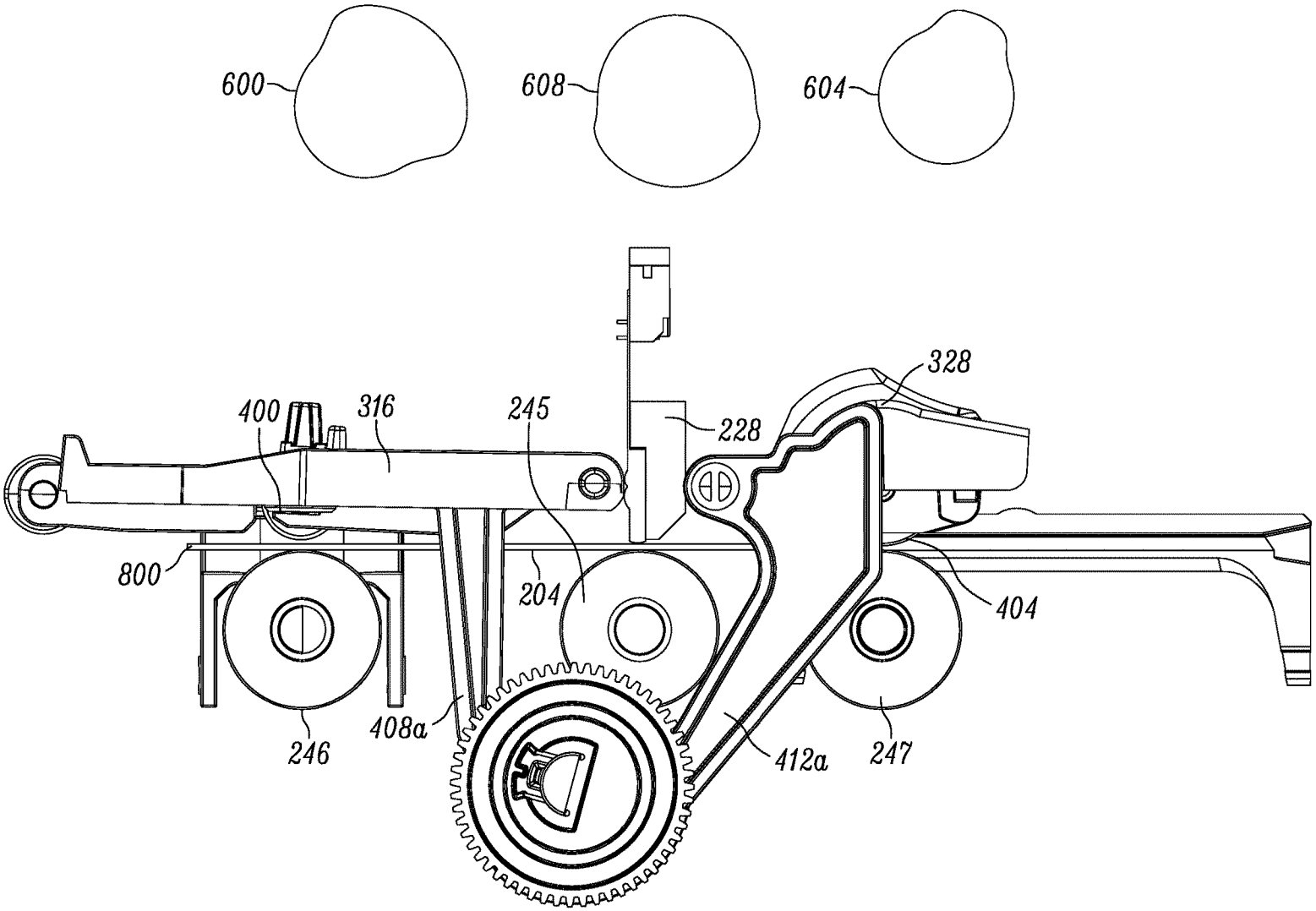

FIG. 10 illustrates the next position in the sequence, in which all three of the upstream and downstream nip roller housings 316 and 328 and the printhead 228 are lowered. The downstream nip roller housing 328 is therefore lowered (from the raised position in FIG. 9) as the leading edge 804 (not visible in FIG. 10) enters the nip thus formed between the downstream drive roller 247 and the downstream nip roller 404. With the cam members 336 in the positions shown in FIG. 10, the controller 260 is configured to continue driving the media unit 204 along the media processing path (e.g. for a predetermined distance, such as a predetermined number of motor steps at the motor driving the rollers 246, 247 and 245). Responsive to the trailing edge 800 approaching the upstream nip roller 400 (e.g. the above-mentioned number of motor steps may be selected to correspond to a travel distance that places the trailing edge 800 adjacent to the upstream nip roller 404), the controller 260 is configured to rotate the cam members 336 to the next position in the sequence.

Figure 11:
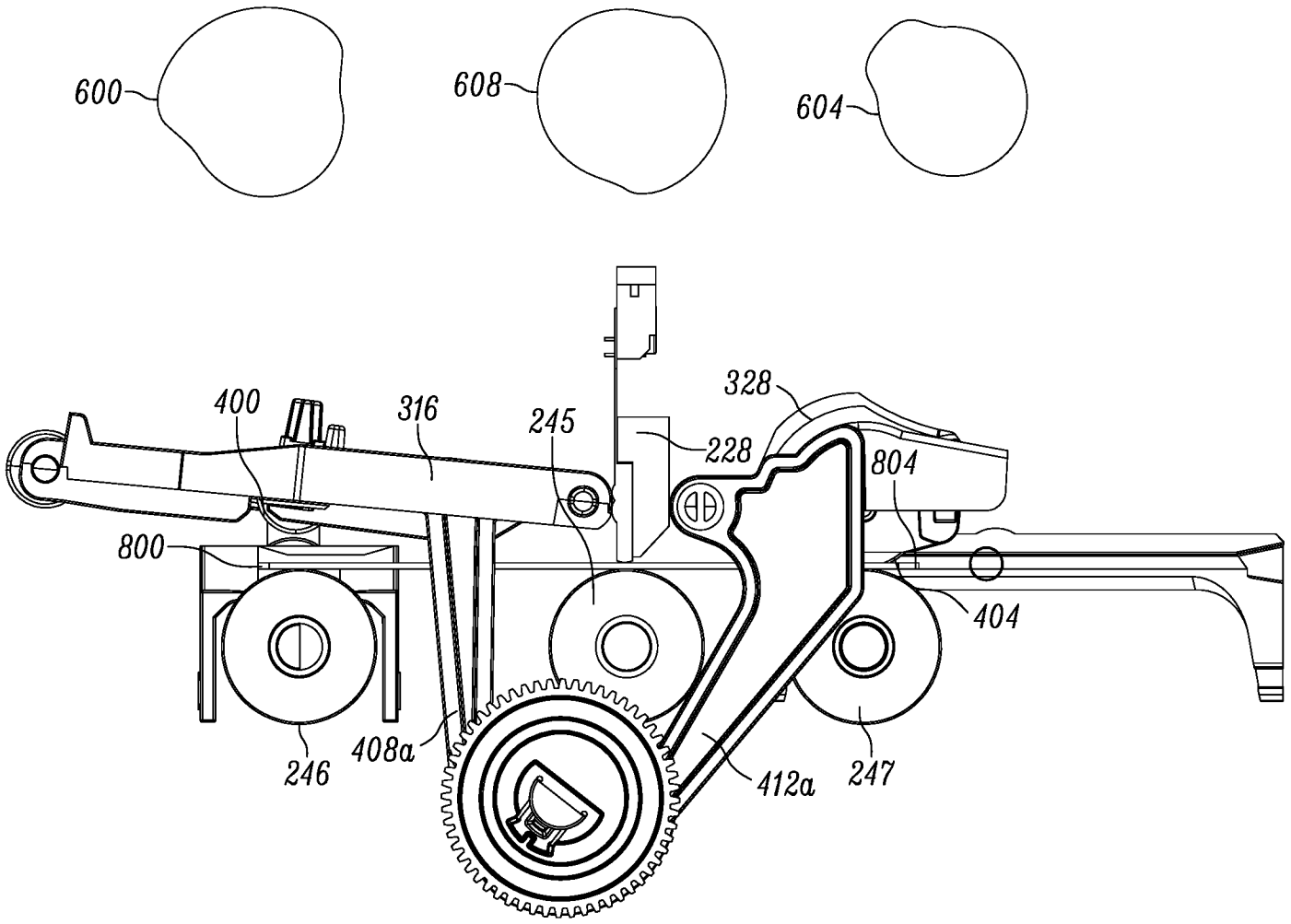

FIG. 11 illustrates the next position in the sequence. Prior to the arrival of the trailing edge 800 at the upstream nip roller 404, the cam members 336 are rotated to move the upstream nip roller housing 316 into the disengaged position, while the printhead 228 and the downstream nip roller housing 328 remain in the engaged positions. As seen in FIG. 11, the leading edge 804 has entered the nip formed by the downstream nip roller 404 and the downstream drive roller 247. As a result, the media unit 204 remains engaged at two points ((i) the printhead 228, and (ii) the downstream nip roller 404 and drive roller 247) when the upstream nip roller 400 disengages from the media unit 204. The controller 260 is configured to continue driving the media unit 204 until the trailing edge 800 approaches the printhead 228. When the trailing edge 800 approaches the printhead 228, the controller 260 is configured to rotate the cam members 336 to the next position in the sequence. The next position in the sequence, as will now be apparent to those skilled in the art, places the nip roller housings 316 and 328, as well as the printhead 228, in the positions shown in FIG. 7.

The controller 260 can be configured to drive the media unit 204 back past the printhead 228, until the card detection sensor mentioned above is obstructed, without moving the cam members 336. In a second pass is required (e.g. to apply additional indicia to the media unit 204), the sequence described above is repeated.

Figure 12A:
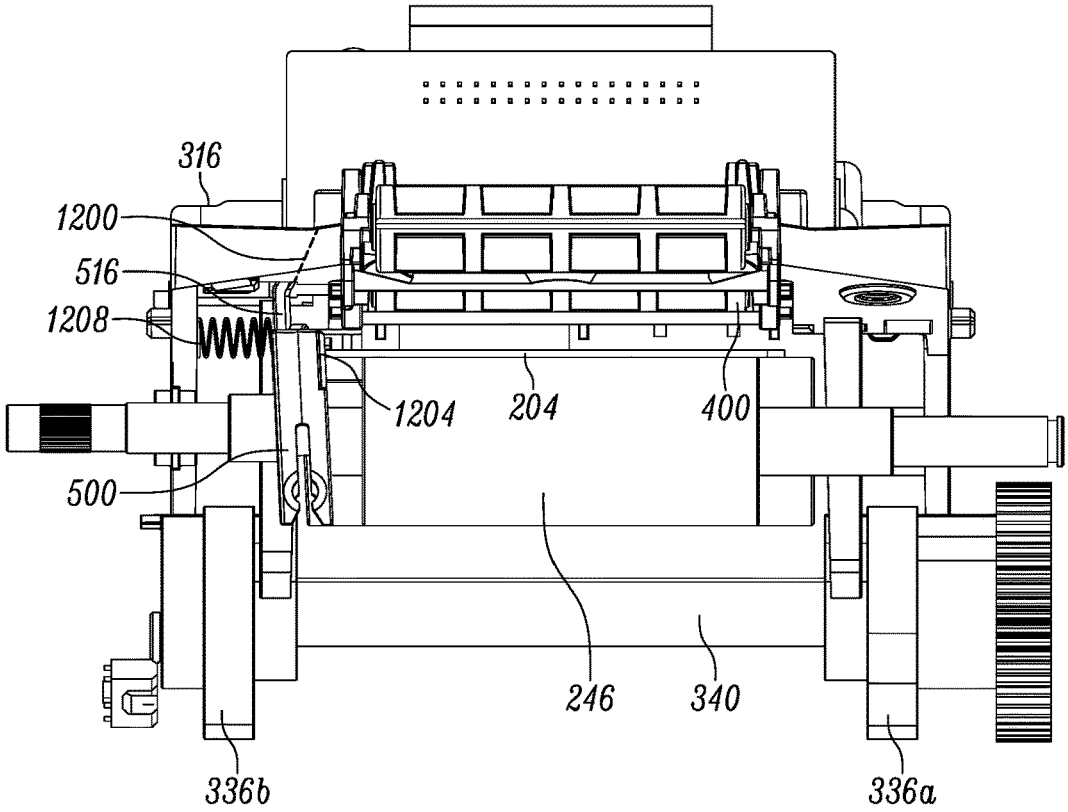
FIGS. 12A-12B depict front elevation views of an upstream registration bar of the media processing device of FIG. 1 in engaged and disengaged operational positions.
Figure 12B:
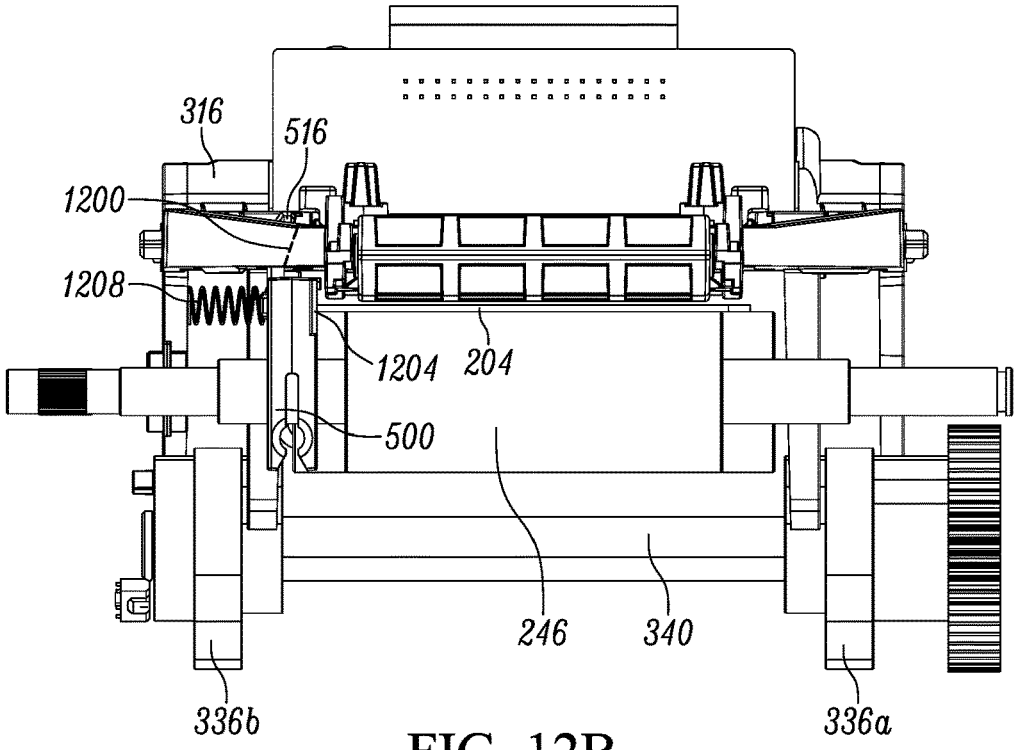

As noted earlier, the registration bars 500 and 504 can be configured, in some examples, to transition between engaged and disengaged positions by rotating about the axes 506 and 508 respectively, responsive to movement of the nip roller housings 316 and 328. Turning to FIGS. 12A and 12B, the movement of the registration bar 500 is described in greater detail.

Referring to FIG. 12A, certain components of the media processing device 100 are shown with the cam members 336 in the positions shown in FIG. 7. Thus, the upstream nip roller housing 316 is raised to lift the upstream nip roller 400 away from the media processing path 216 and the media unit 204. The nip roller housing 316 includes a channel for receiving the post 516. In particular, the channel includes an inclined wall 1200, shown as a dashed line in FIG. 12A, configured to engage the post 516. Thus, as the housing 316 raises, the inclined wall 1200 pushes the post 516 outwards (i.e. away from the center of the media processing path 216).

As a result, a guide plate 1204 of the registration shifts away from a side edge of the media unit 204.

Referring to FIG. 12B, on the other hand, when the nip roller housing 316 is lowered (as shown in FIG. 8), the post 516 is permitted by the inclined wall 1200 to travel inwards, bringing the guide plate 1204 into contact with the media unit 204. The registration bar 500 can be biased towards the engaged position shown in FIG. 12B, for example by a bias member 1208 such as a spring (e.g. the other end of which is coupled to the upstream support member 304). Accordingly, when the upstream nip roller housing 316 is raised prior to engaging the media unit 204, the upstream registration bar 500 is in the disengaged position to permit ready entry of the media unit 204 into the nip to be formed by the upstream drive roller 246 and the upstream nip roller 400. As the above nip is engaged with the media unit 204 via lowering of the upstream nip roller housing 316, the upstream registration bar 500 is also engaged with the media unit 204, to align the media unit 204 on the media processing path 216 prior to engagement with the printhead 228.

Figure 13A:
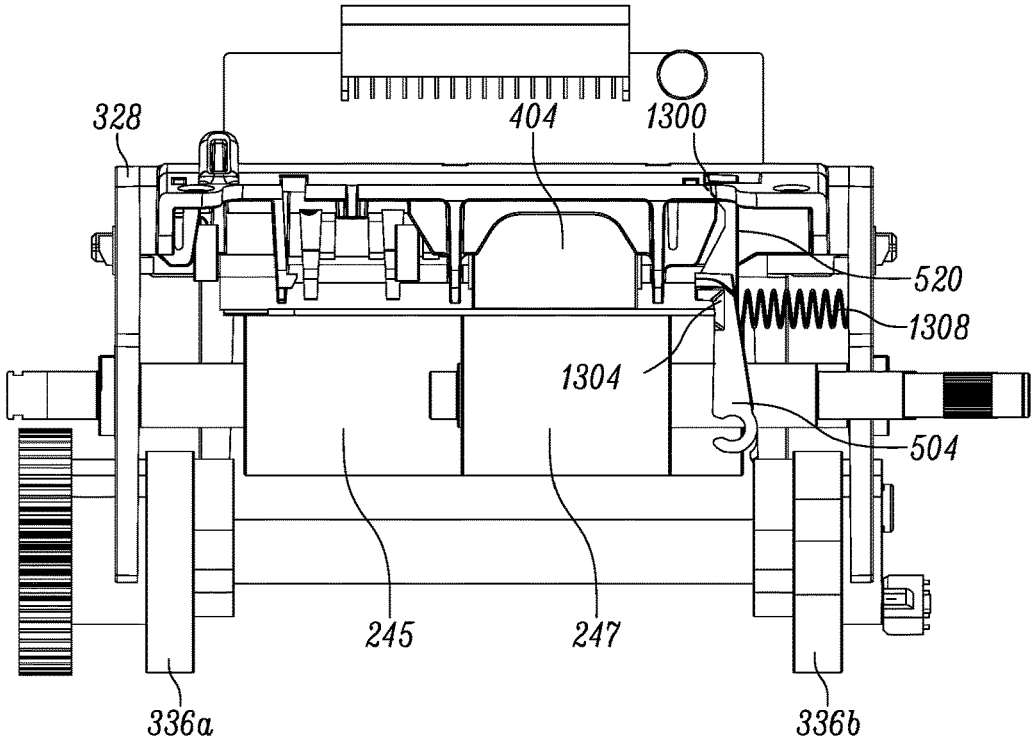
FIGS. 13A-13B depict rear elevation views of a downstream registration bar of the media processing device of FIG. 1 in engaged and disengaged operational positions.
Figure 13B:
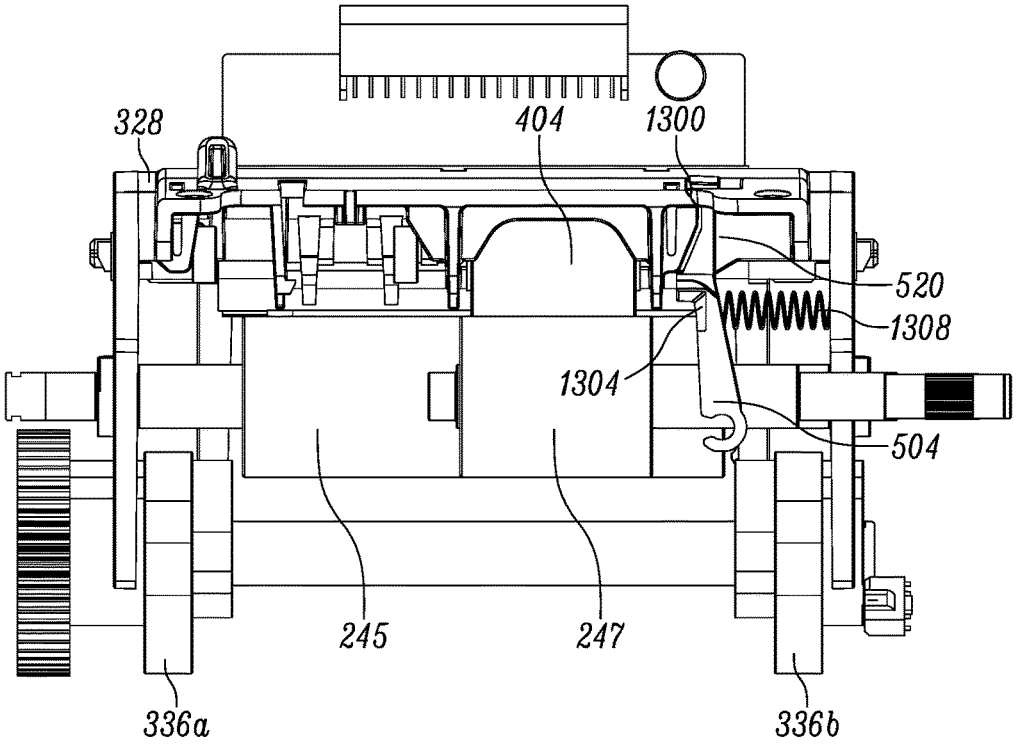

Turning to FIGS. 13A and 13B, the operation of the downstream registration bar 504 will be described in greater detail. The downstream nip roller housing 328 also includes a channel with an inclined surface 1300 configured to engage the post 520. Thus, when the downstream nip roller housing 328 is raised (as in FIG. 9) to lift the downstream nip roller 404 away from the media processing path (and the downstream drive roller 247), the inclined surface 1300 pushes the post 520 outwards into the position shown in FIG. 13A. A guide plate 1304 of the registration bar 504 is therefore moved away from the media processing path 216. In other examples, either or both of the inclined surfaces 1200 and 1300 can be provided on components coupled to or otherwise engaged with the housings 316 and 328, respectively, rather than being integral parts of the housings 316 and 328.

When the downstream nip roller housing 328 is lowered into the position shown in FIG. 13B (as in FIG. 10), the post 520 travels inwards along the inclined surface 1300 and the registration bar 504 transitions to the engaged position shown, for aligning the media unit 204 with the media processing path 216. The registration bar 504 can be biased towards the engaged position by a bias member 1308, such as a spring connected to the downstream support member 308.

Variations to the features of the media processing device 100 discussed above are contemplated. For example, in other implementations the upstream and downstream nip roller housings 316 and 328 may be omitted. The arms 408 and 412 may instead extend from one or more ends of the shafts on which the movable rollers 400 and 404 rotate, for example. In further variations, the movement of the nip roller housings 316 and 328 may be controlled via assemblies other than the cams and related structures described above. For example, the motor 348 can be implemented as one or more linear actuators (e.g. one or more solenoids) configured to lift and lower either or both of the housings 316 and 328.

In further variations, one of the upstream and downstream drive assemblies 310 and 324 is implemented without the movable roller discussed above. That is, one of the upstream and downstream drive assemblies 310 and 324 includes a fixed roller and a movable roller, as described above, while the other of the drive assemblies 310 and 324 includes a pair of fixed rollers. In such embodiments, one or both of the fixed rollers in the drive assembly lacking a movable roller can be fabricated from a material with a lower hardness than the other roller (or than the rollers of the assembly equipped with a movable roller).

In this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The above description refers to block diagrams of the accompanying drawings. Alternative implementations of the examples represented by the block diagrams include one or more additional or alternative elements, processes and/or devices. Additionally or alternatively, one or more of the example blocks of the diagrams may be combined, divided, re-arranged or omitted. Components represented by the blocks of the diagrams are implemented by hardware, software, firmware, and/or any combination of hardware, software and/or firmware. In some examples, at least one of the components represented by the blocks is implemented by a logic circuit. As used herein, the term "logic circuit" is expressly defined as a physical device including at least one hardware component configured (e.g., via operation in accordance with a predetermined configuration and/or via execution of stored machine-readable instructions) to control one or more machines and/or perform operations of one or more machines. Examples of a logic circuit include one or more processors, one or more coprocessors, one or more microprocessors, one or more controllers, one or more digital signal processors (DSPs), one or more application specific integrated circuits (ASICs), one or more field programmable gate arrays (FPGAs), one or more microcontroller units (MCUs), one or more hardware accelerators, one or more special-purpose computer chips, and one or more system-on-a-chip (SoC) devices. Some example logic circuits, such as ASICs or FPGAs, are specifically configured hardware for performing operations (e.g., one or more of the operations represented by the flowcharts of this disclosure). Some example logic circuits are hardware that executes machine-readable instructions to perform operations (e.g., one or more of the operations represented by the flowcharts of this disclosure). Some example logic circuits include a combination of specifically configured hardware and hardware that executes machine-readable instructions.

The above description refers to flowcharts of the accompanying drawings. The flowcharts are representative of example methods disclosed herein. In some examples, the methods represented by the flowcharts implement the apparatus represented by the block diagrams. Alternative implementations of example methods disclosed herein may include additional or alternative operations. Further, operations of alternative implementations of the methods disclosed herein may combined, divided, re-arranged or omitted. In some examples, the operations represented by the flowcharts are implemented by machine-readable instructions (e.g., software and/or firmware) stored on a medium (e.g., a tangible machine-readable medium) for execution by one or more logic circuits (e.g., processor(s)). In some examples, the operations represented by the flowcharts are implemented by one or more configurations of one or more specifically designed logic circuits (e.g., ASIC(s)). In some examples the operations of the flowcharts are implemented by a combination of specifically designed logic circuit(s) and machine-readable instructions stored on a medium (e.g., a tangible machine-readable medium) for execution by logic circuit(s).

As used herein, each of the terms "tangible machine-readable medium," "non-transitory machine-readable medium" and "machine-readable storage device" is expressly defined as a storage medium (e.g., a platter of a hard disk drive, a digital versatile disc, a compact disc, flash memory, read-only memory, random-access memory, etc.) on which machine-readable instructions (e.g., program code in the form of, for example, software and/or firmware) can be stored. Further, as used herein, each of the terms "tangible machine-readable medium," "non-transitory machine-readable medium" and "machine-readable storage device" is expressly defined to exclude propagating signals. That is, as used in any claim of this patent, none of the terms "tangible machine-readable medium," "non-transitory machine-readable medium," and "machine-readable storage device" can be read to be implemented by a propagating signal.

As used herein, each of the terms "tangible machine-readable medium," "non-transitory machine-readable medium" and "machine-readable storage device" is expressly defined as a storage medium on which machine-readable instructions are stored for any suitable duration of time (e.g., permanently, for an extended period of time (e.g., while a program associated with the machine-readable instructions is executing), and/or a short period of time (e.g., while the machine-readable instructions are cached and/or during a buffering process)).

Although certain example apparatus, methods, and articles of manufacture have been disclosed herein, the scope of coverage of this patent is not limited thereto. On the contrary, this patent covers all apparatus, methods, and articles of manufacture fairly falling within the scope of the claims of this patent.

The invention claimed is:

1. A media processing device, comprising:

a platen roller configured to move a media unit along a media processing path to traverse a printhead adjacent to the platen roller;

an upstream drive assembly including (i) an upstream stationary roller disposed along the media processing path on a first side of the platen roller; and (ii) an upstream movable roller adjacent to the upstream stationary roller;

a downstream drive assembly including (i) a downstream stationary roller disposed along the media processing path on a second side of the platen roller; and (ii) a downstream movable roller adjacent to the downstream stationary roller;

a controller configured to:

control a motor to move, according to a predefined sequence, the upstream movable roller and the downstream movable roller between respective engaged and disengaged positions;

responsive to arrival of a leading edge of the media unit at the upstream stationary roller, control the motor to move the upstream movable roller into the engaged position; and control the motor to maintain the upstream movable roller in the engaged position until the leading edge arrives at the downstream stationary roller.

2. The media processing device of claim 1, the controller further configured to control the motor to lift the upstream movable roller into the disengaged position prior to a trailing edge of the media unit traversing the upstream stationary roller.

3. The media processing device of claim 1, the controller further configured to control the motor to lift the downstream movable roller into the disengaged position prior to the leading edge of the media unit traversing the downstream stationary roller.

4. The media processing device of claim 1, the controller further configured, responsive to the leading edge of the media unit arriving at the downstream stationary roller, to control the motor to:

move the downstream movable roller into the engaged position; and lift the upstream movable roller into the disengaged position prior to arrival of a trailing edge of the media unit at the upstream movable roller.

5. The media processing device of claim 1, wherein the upstream drive assembly further comprises a movable upstream roller housing supporting the upstream movable roller; and wherein the downstream drive assembly further comprises a movable downstream roller housing supporting the downstream movable roller.

6. The media processing device of claim 5, further comprising:

a registration bar biased toward the media processing path and having a post extending into engagement with the downstream movable roller housing;

the downstream movable roller housing having a cam surface for engaging the post to force the registration bar away from the media processing path when the downstream movable roller housing is lifted into the disengaged position.

7. The media processing device of claim 5, further comprising:

a motor output connected to a control shaft for driving the control shaft;

a plurality of cam surfaces mounted on the control shaft for engaging the upstream movable roller housing and the downstream movable roller housing.

8. The media processing device of claim 6, further comprising:

a first cam member mounted on a control shaft and including a first subset of the cam surfaces; and a second cam member mounted on the control shaft and including a second subset of the cam surfaces.

9. The media processing device of claim 8, wherein in the upstream moveable roller housing includes a first arm extending into engagement with the first cam member; and wherein the downstream moveable roller housing includes a second arm extending into engagement with the second cam member.

10. The media processing device of claim 9, wherein the printhead is adjacent to the platen roller and movable between an idle position and an active position for engaging the media unit.

11. The media processing device of claim 10, further comprising:

a third cam member mounted on the nip roller control shaft and including a third subset of the cam surfaces.

12. The media processing device of claim 11, wherein the printhead includes a third arm extending into engagement with the third cam member.

13. The media processing device of claim 12, the controller further configured to control the motor to move the upstream moveable roller housing, the printhead, and the downstream moveable roller housing according to the predetermined sequence by:

for each of a plurality of stages in the sequence, controlling the motor to advance through a predetermined arc to position the first, second and third cam members.

14. The media processing device of claim 13, wherein each predetermined arc is defined by a number of steps.

15. The media processing device of claim 1, wherein in the engaged position, the upstream movable roller is at a first distance from the upstream stationary roller to form a nip for engaging the media unit; and wherein in the disengaged position, the upstream movable roller is at a second distance, greater than the first distance, from the upstream stationary roller to release the nip.

16. The media processing device of claim 1, wherein in the engaged position, the downstream movable roller is at a first distance from the downstream stationary roller to form a nip for engaging the media unit; and wherein in the disengaged position, the downstream movable roller is at a second distance, greater than the first distance, from the downstream stationary roller to release the nip.

17. The media processing device of claim 1, further comprising:

a ribbon cassette including (i) a supply roller, (ii) a take-up roller driven by a take-up motor, and (iii) a ribbon configured to travel from the supply roller to the take-up roller, traversing the printhead;

a rotational sensor coupled to the take-up roller;

the controller further configured to receive a sensor signal from the rotational sensor indicative of a rotational speed of the take-up roller, and to modulate an operational parameter of the take-up motor based on the sensor signal.

18. The media processing device of claim 17, wherein the rotational sensor is a quadrature encoder.

19. A media processing device, comprising:

a platen roller configured to move a media unit along a media processing path to traverse a printhead adjacent to the platen roller;

an upstream drive assembly including (i) an upstream stationary roller disposed along the media processing path on a first side of the platen roller; (ii) an upstream movable roller adjacent to the upstream stationary roller; and (iii) a movable upstream roller housing supporting the upstream movable roller;

a downstream drive assembly including (i) a downstream stationary roller disposed along the media processing path on a second side of the platen roller; (ii) a downstream movable roller adjacent to the downstream stationary roller; and (iii) a movable downstream roller housing supporting the downstream movable roller;

a controller configured to control a motor to move, according to a predefined sequence, the upstream movable roller and the downstream movable roller between respective engaged and disengaged positions.

20. A media processing device, comprising:

a platen roller configured to move a media unit along a media processing path to traverse a printhead adjacent to the platen roller;

an upstream drive assembly including (i) an upstream stationary roller disposed along the media processing path on a first side of the platen roller; and (ii) an upstream movable roller adjacent to the upstream stationary roller;

a downstream drive assembly including (i) a downstream stationary roller disposed along the media processing path on a second side of the platen roller; and (ii) a downstream movable roller adjacent to the downstream stationary roller;

a controller configured to control a motor to move, according to a predefined sequence, the upstream movable roller and the downstream movable roller between respective engaged and disengaged positions;

a ribbon cassette including (i) a supply roller, (ii) a take-up roller driven by a take-up motor, and (iii) a ribbon configured to travel from the supply roller to the take-up roller, traversing the printhead;

a rotational sensor coupled to the take-up roller;

the controller further configured to receive a sensor signal from the rotational sensor indicative of a rotational speed of the take-up roller, and to modulate an operational parameter of the take-up motor based on the sensor signal.

* * * * *